US006719587B2

(12) United States Patent
Droesbeke et al.

(10) Patent No.: US 6,719,587 B2
(45) Date of Patent: Apr. 13, 2004

(54) RIGHT-ANGLED CONNECTOR

(75) Inventors: Gert Droesbeke, Nijlen (BE); Ivan Joachim Grek, Katrineholm (SE)

(73) Assignee: FCI, Versailles (FR)

( * ) Notice: Subject to any disclaimer, the term of this patent is extended or adjusted under 35 U.S.C. 154(b) by 7 days.

(21) Appl. No.: 10/160,316

(22) Filed: May 30, 2002

(65) Prior Publication Data

US 2002/0192988 A1 Dec. 19, 2002

(30) Foreign Application Priority Data

May 30, 2001 (NL) ..... 1018176

(51) Int. Cl.[7] ..... H01R 13/648
(52) U.S. Cl. ..... 439/608; 439/607; 439/609
(58) Field of Search ..... 439/606–609

(56) References Cited

U.S. PATENT DOCUMENTS

| | | | | |
|---|---|---|---|---|
| 4,611,867 A | | 9/1986 | Ichimura et al. | 339/14 R |
| 4,846,727 A | | 7/1989 | Glover et al. | 439/608 |
| 5,518,422 A | | 5/1996 | Zell et al. | 439/608 |
| 6,231,391 B1 | * | 5/2001 | Ramey et al. | 439/608 |
| 6,322,379 B1 | * | 11/2001 | Ortega et al. | 439/108 |
| 2002/0048995 A1 | * | 4/2002 | Shindo | 439/608 |
| 2002/0160658 A1 | * | 10/2002 | Sipe | 439/608 |

FOREIGN PATENT DOCUMENTS

| | | |
|---|---|---|
| EP | 0 446 980 A1 | 9/1991 |
| EP | 0 693 795 A1 | 1/1996 |
| EP | 1 018 785 A1 | 7/2000 |
| GB | 2 027 290 A | 2/1980 |
| WO | 01/01527 | 1/2001 |

* cited by examiner

*Primary Examiner*—Michael C. Zarroli
(74) *Attorney, Agent, or Firm*—Harrington & Smith, LLP

(57) ABSTRACT

A connector comprises a housing of insulating material and a number of right-angled contact elements arranged in rows and columns. A right-angled shielding plate is arranged between all adjacent rows or adjacent groups of rows of contact elements. Further, adjacent columns or adjacent groups of columns of contact elements are separated by a vertical shielding plate. The right-angled and vertical shielding plates are provided with slots receiving the vertical and right-angled shielding plates, respectively. Contact parts are provided for interconnecting the right-angled and vertical shielding plates.

11 Claims, 3 Drawing Sheets

RIGHT-ANGLED CONNECTOR

BACKGROUND OF THE INVENTION

The invention relates to a connector, comprising a housing of insulating material having a front wall and a bottom wall, a number of right-angled contact elements arranged in rows and columns, and at least one right-angled shielding plate arranged between two adjacent rows of contact elements.

GB-A-2 027 290 discloses a connector of this type, having three rows of right-angled contact elements, wherein the central row is a row of ground contact elements. The right-angled shielding plate is arranged between the central and outer rows of contact elements and interconnects the ground contact elements of the central row. This known connector requires a number of ground contact elements thereby reducing the density of signal contact elements. There is no shielding between columns of contact elements.

EP-A-0 446 980 discloses a connector, comprising a housing of insulating material, and a number of right-angled contact elements arranged in rows and columns, wherein signal contacts are enclosed by outer conductors and shielding plates are provided to improve shielding. The connector requires a number of ground contact elements for shielding thereby reducing signal contact density.

U.S. Pat. No. 4,611,867 discloses a connector, comprising a housing of insulating material, a number of straight contact elements arranged in rows and columns and a matrix of shielding plates. The connector is made as a coaxial multicore receptacle. A number of ground contact pins is required to contact the shielding plates.

U.S. Pat. No. 4,846,727 discloses a connector, comprising a housing of insulating material, a number of right-angled contact elements arranged in rows and columns and a number of shielding plates arranged between adjacent columns of contact elements. There is no shielding between rows of contact elements.

The invention aims to provide an improved connector of the above-mentioned type.

To this end the connector according to the invention is characterized in that a right-angled shielding plate is arranged between all adjacent rows or adjacent groups of rows of contact elements, and wherein adjacent columns or adjacent groups of columns of contact elements are separated by a vertical shielding plate, wherein the right-angled and vertical shielding plates are provided with slots receiving the vertical and right-angled shielding plates, respectively, wherein contact parts are provided for interconnecting the right-angled and vertical shielding plates.

In this manner a right-angled connector with a complete shielding of contact elements both in row and column direction is obtained.

BRIEF DESCRIPTION OF DRAWINGS

The invention will be further explained by reference to the drawings in which an embodiment of the connector assembly of the invention is shown.

Referring to FIGS. 1 and 2 there is shown a right-angled connector or header, comprising a housing 1 of insulating material having a front wall 2 and a bottom wall 3. A number of right-angled contact elements 4 are arranged in rows and columns. Arrows R and C in FIG. 1 schematically show the row or horizontal direction and column or vertical direction. Each contact element 4 comprises a contact end or pin 5 adapted to contact a contact element of a mating connector, an intermediate right-angled section 6, and a terminal end 7 adapted to be inserted into a plated through-hole of a printed circuit board. It will be understood that the configuration of the contact elements 4 is shown by way of example only and different configurations are possible.

Figure 2:
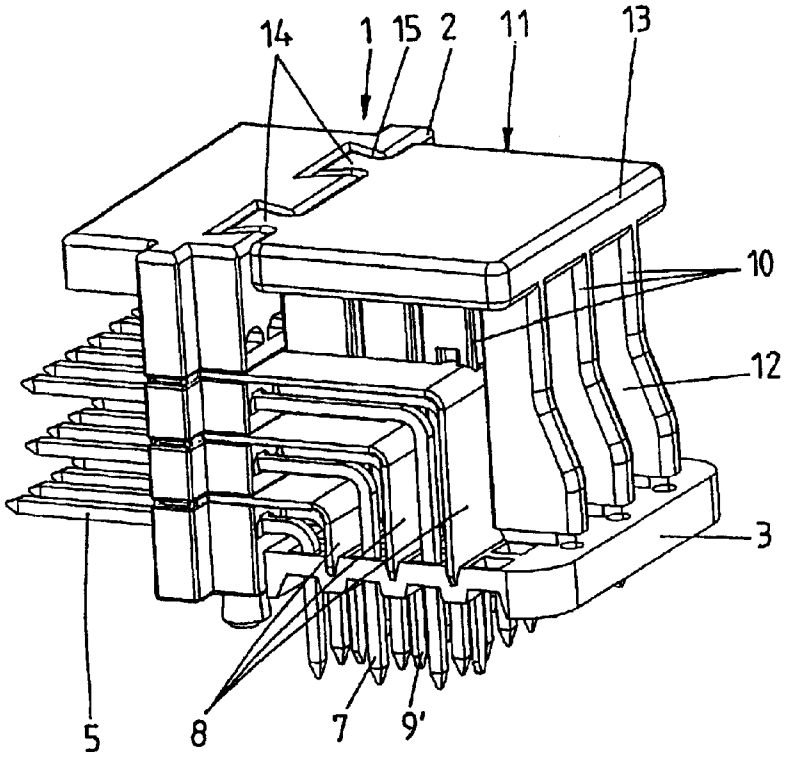
FIGS. 1 and 2 show perspective views of an embodiment of the connector according to the invention.

A right-angled shielding plate 8 is arranged between each two adjacent rows of contact elements 4 so that the rows of contact elements 4 are completely shielded with respect to each other. Each right-angled shielding plate is provided with contact lips 9 projecting out of the front wall 2 and with terminal ends 9' projecting out of the bottom wall 3. Further, adjacent pairs of columns of contact elements 4 are separated by a vertical shielding plate 10. As will be described hereinafter, the vertical shielding plates 10 are interconnected with the right-angled shielding plates 8. In this manner a complete shielding of each pair of contact elements 4 is obtained. In the embodiment shown each row comprises eight contact elements and with four rows this results in sixteen completely shielded pairs of contact elements 4. It will be understood that different arrangements of the right-angled and vertical shielding plates are possible. For example, the vertical shielding plates can be provided between each two adjacent columns of contact elements 4 to obtain individually shielded contact elements 4. In a different layout, a right-angled shielding plate 8 could be arranged between adjacent groups of rows of contact elements.

DETAILED DESCRITPTION OF THE INVENTION

Figure 1:
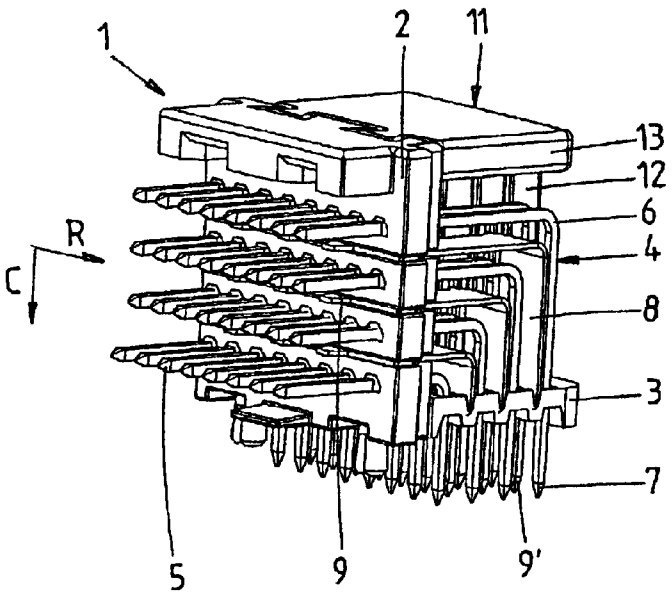
Figure 6:
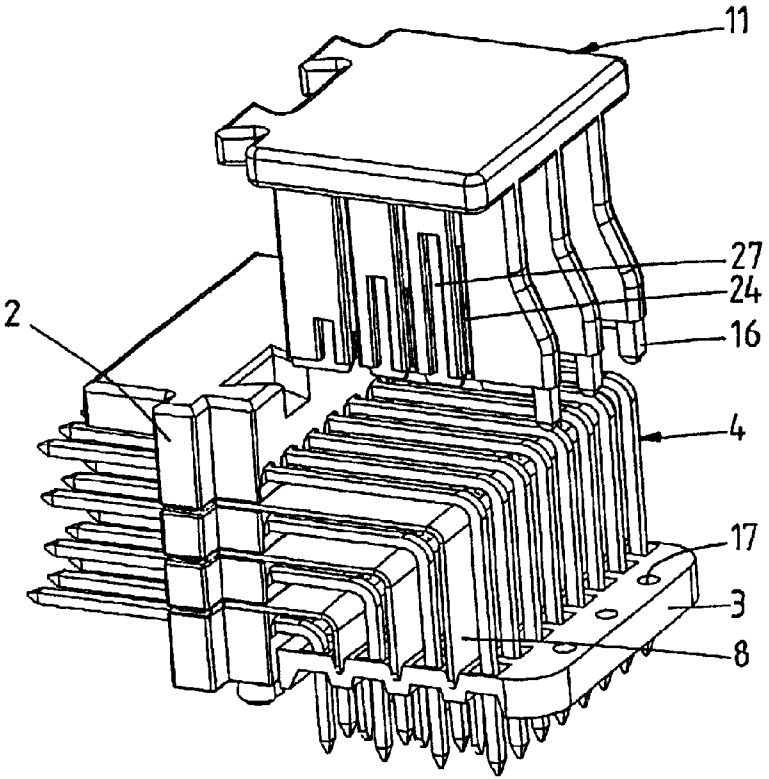

As shown in FIGS. 1 and 2, the vertical shielding plates 10 are part of a vertical shielding element 11 overmoulded with an insulating material 12. This vertical shielding element 11 comprises an upper wall 13 from which the vertical shielding plates 10 extend downwards. If desired, a metal plate interconnected with the vertical shielding plates 10 can be accommodated within the upper wall 13. The upper wall 13 is provided with two locking projections 14 engaging in locking recesses 15 of the front wall 2 of the housing 1. As can be seen in FIG. 6, the overmoulded vertical shielding plates are provided with coupling pins 16 and these coupling pins 16 are received in holes 17 of the bottom wall 3 of the housing 1. In this manner a rigid construction of the connector is obtained. It will be understood that the connector of FIGS. 1 and 2 can be provided with outer shielding plates in a usual manner.

Figure 4:
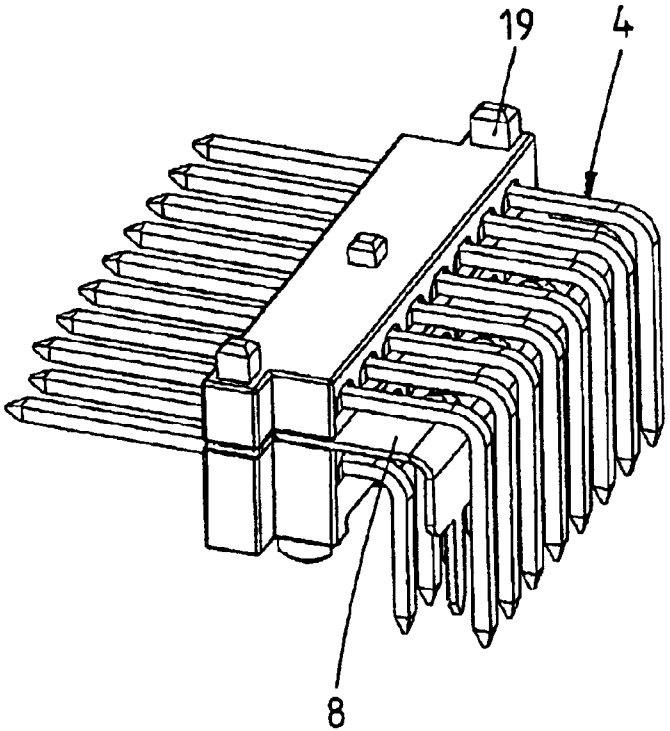
FIGS. 3–6 show perspective views of some steps in a method of the invention for manufacturing the connector of FIGS. 1 and 2.
Figure 3:
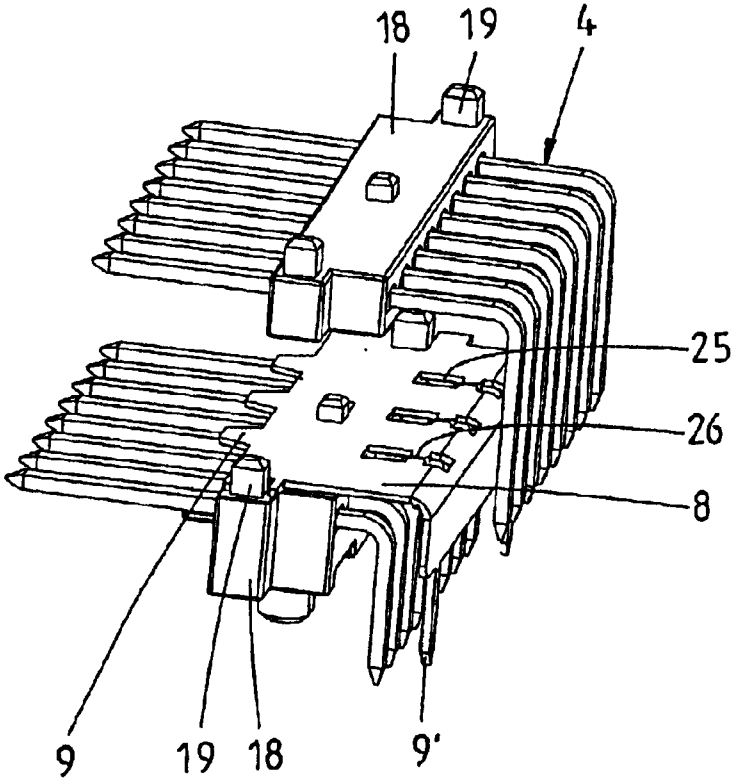
Figure 5:
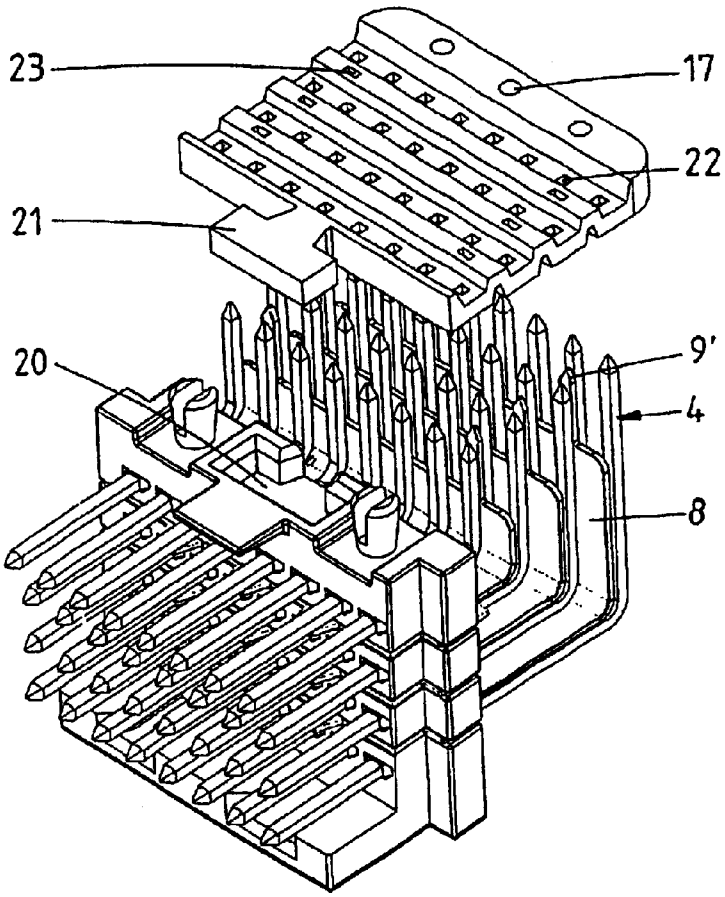

For a further detailed description of the construction of the connector and the method for manufacturing the connector reference is now made to FIGS. 3–6. The front wall 2 of the housing comprises for front wall parts 18, which are interconnected by projections 19 received in recesses not shown. The contact elements 4 are inserted into holes in the front wall parts 18 as straight contact elements and are bent to obtain the right-angled contact elements 4. Thereafter, a first right-angled shielding plate 8 is mounted on top of the front wall part 18 as shown in FIG. 3. A next front wall part 18 with inserted and bent contact elements 4 is mounted on top of the first front wall part 18 with shielding plate 8 and locked onto the same so that the assembly as shown in FIG. 4 is obtained. Further right-angled shielding plates 8 and front wall parts 18 with inserted contact elements 4 are mounted on top of the previous front wall parts 18 to obtain the assembly as shown in FIG. 5.

As can be seen in FIG. 5, the lower front wall part 18 is provided with a locking recess 20 to receive a locking projection 21 of the bottom wall 3. This bottom wall 3 is provided with holes 22 to receive and position the terminal ends 7 of the contact elements 4 and with holes 23 to receive and position the terminal ends 9' of the right-angled shielding plates 8. When the bottom wall 3 is provided, the vertical shielding element 11 can be mounted as shown in FIG. 6. The coupling pins 16 are received in the holes 17 of the bottom wall 3 and the locking projections 14 are received in the locking recesses 15.

The vertical shielding plates 10 are provided with slots 24 to receive the vertical parts of the right-angled shielding plates 8. Further, the right-angled shielding plates 8 are provided with slots 25 (see FIG. 3) to receive the vertical shielding plates 10. These slots 25 of the right-angled shielding plates 8 are provided with contact fingers 26 to contact the vertical shielding plates 10. To provide these contact fingers 26 with access to the vertical shielding plates 10, the insulating material overmoulded on the vertical shielding plates 10 is provided with slots 27.

It is noted that the interconnection between the shielding plates 8, 10 by means of the contact fingers 26 is given by way of example only. As an alternative, the slots 24 in the vertical shielding plates 10 can be provided with contact fingers contacting the vertical parts of the right-angled shielding plates 8. Further, different embodiments of the contact fingers are possible.

It will be understood that the connector of the invention allows a complete shielding both in vertical and horizontal direction of one or a group of contact elements 4. In this manner the connector is suitable for high-speed signals. Manufacturing of the connector is possible in an efficient way and results in a rigid construction.

The invention is not restricted to the above-described embodiments, which can be varied in a number of ways within the scope of the attached claims.

What is claimed is:

1. Connector comprising:

a housing of insulating material having a front wall and a bottom wall, a number of right-angled contact elements arranged in rows and columns, and at least one right-angled shielding plate arranged between two adjacent rows of contact elements, characterized in that the at least one right-angled shielding plate is arranged between all adjacent rows or adjacent groups of rows of contact elements, and wherein adjacent columns or adjacent groups of columns of contact elements are separated by a vertical shielding plate, wherein the right-angled and vertical shielding plates are provided with slots receiving the vertical and right-angled shielding plates, respectively, wherein contact parts are provided for interconnecting the right-angled and vertical shielding plates, wherein the vertical shielding plates are part of a vertical shielding element with an overmolded insulating material.

2. Connector according to claim 1, wherein the slots of the right-angled shielding plates are provided with contact fingers and the insulating material of the vertical shielding element has slots for allowing the contact fingers of a right-angled shielding plate to contact the vertical shielding plates.

3. Connector according to claim 1, wherein the vertical shielding element is provided with an insulating coupling pin aligned with each vertical shielding plate, wherein each coupling pin is received in a hole of the bottom wall of the housing.

4. Connector according to claim 1, wherein the vertical shielding element comprises an upper wall from which the overmolded vertical shielding plates extend downwards, said upper wall having one or more locking projections engaging locking recesses provided in the front wall of the housing.

5. Connector according to claim 1, wherein the bottom wall of the housing is provided with a locking projection engaging in a recess provided in the front wall of the housing.

6. Connector according to claim 1, wherein each row of contact elements is a row of signal contact elements only.

7. Connector comprising:

a housing of insulating material having a front wall and a bottom wall, a number of right-angled contact elements arranged in rows and columns, and at least one right-angled shielding plate arranged between two adjacent rows of contact elements, characterized in that the at least one right-angled shielding plate is arranged between all adjacent rows or adjacent groups of rows of contact elements, and wherein adjacent columns or adjacent groups of columns of contact elements are separated by a vertical shielding plate, wherein the right-angled and vertical shielding plates are provided with slots receiving the vertical and right-angled shielding plates, respectively, wherein contact parts are provided for interconnecting the right-angled and vertical shielding plates, wherein each right-angled shielding plate is provided with at least one contact lip projecting out of the front wall of the housing for contacting a mating connector and at least one ground terminal projecting out of the bottom wall for contacting a printed circuit board.

8. Connector comprising:

a housing of insulating material having a front wall and a bottom wall, a number of right-angled contact elements arranged in rows and columns, and at least one right-angled shielding plate arranged between two adjacent rows of contact elements, characterized in that the at least one right-angled shielding plate is arranged between all adjacent rows or adjacent groups of rows of contact elements, and wherein adjacent columns or adjacent groups of columns of contact elements are separated by a vertical shielding plate, wherein the right-angled and vertical shielding plates are provided with slots receiving the vertical and right-angled shielding plates, respectively, wherein contact parts are provided for interconnecting the right-angled and vertical shielding plates, wherein the front wall of the housing is an assembly of front wall parts, each front wall part carrying one row of contact elements, wherein each right-angled shielding plate is received between the front wall parts of two adjacent rows of contact elements.

9. Connector according to claim 8, wherein front wall parts of adjacent rows of contact elements are interlocked by co-operating locking means.

10. Method for manufacturing a connector comprising:

a housing of insulating material having a front wall and a bottom wall, a number of right-angled contact elements arranged in rows and columns, and at least one right-angled shielding plate arranged between two adjacent rows of contact elements, characterized in that the at least one right-angled shielding plate is arranged between all adjacent rows or adjacent groups of rows of contact elements, and wherein adjacent columns or adjacent groups of columns of contact elements are separated by a vertical shielding plate, wherein the right-angled and vertical shielding plates are provided with slots receiving the vertical and right-angled shielding plates, respectively, wherein contact parts are provided for interconnecting the right-angled and vertical shielding plates, characterized by inserting contact elements in one or more front wall part of insulating material, mounting a right-angled shielding plate to a front wall part, mounting a next front wall part with contact elements on the front wall part having the right-angled shielding, and after having assembled all front wall parts, mounting a bottom wall having an array of holes for receiving and positioning one end of each contact element.

11. Method according to claim 10, wherein the contact elements are inserted as straight elements, wherein the contact elements are bent to obtain right-angled contact elements before mounting the right-angled shielding plate.

* * * * *